175-40 SR
8/18/81 OR 4,284,149

United States Patent [19]

Fox

[11] 4,284,149

[45] Aug. 18, 1981

[54] WELL DRILLING TOOL

[75] Inventor: Fred K. Fox, Houston, Tex.

[73] Assignee: Engineering Enterprises, Inc., Houston, Tex.

[21] Appl. No.: 33,554

[22] Filed: Apr. 27, 1979

[51] Int. Cl.[3] ..... E21B 47/00

[52] U.S. Cl. ..... 175/40; 175/228; 175/107; 175/237

[58] Field of Search ..... 175/39, 40, 227, 228, 175/229, 107, 106, 318, 104, 105

[56] References Cited

U.S. PATENT DOCUMENTS

| | | | |
|---|---|---|---|
| 3,866,988 | 2/1975 | Striegler | 175/107 X |
| 3,997,009 | 1/1976 | Fox | 175/107 |
| 4,114,702 | 9/1978 | Maurer et al. | 175/228 X |

FOREIGN PATENT DOCUMENTS

| | | | |
|---|---|---|---|
| 2332412 | 6/1977 | France | 175/107 |

*Primary Examiner*—James A. Leppink
*Assistant Examiner*—Richard E. Favreau
*Attorney, Agent, or Firm*—Marvin B. Eickenroht; Jennings B. Thompson

[57] ABSTRACT

A well drilling tool is disclosed as having a reservoir for supplying lubricant to a bearing chamber to replace that which is lost during operation of the tool, and a means for indicating to an operator at surface level when a predetermined volume of such lubricant has been lost.

17 Claims, 4 Drawing Figures

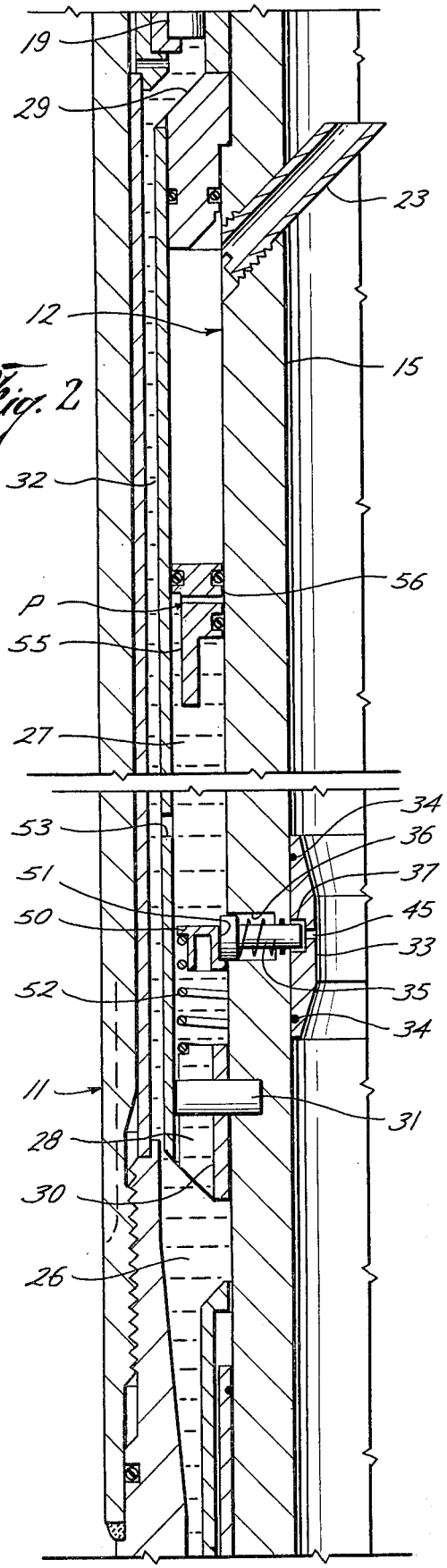
Fig. 2
Fig. 3A
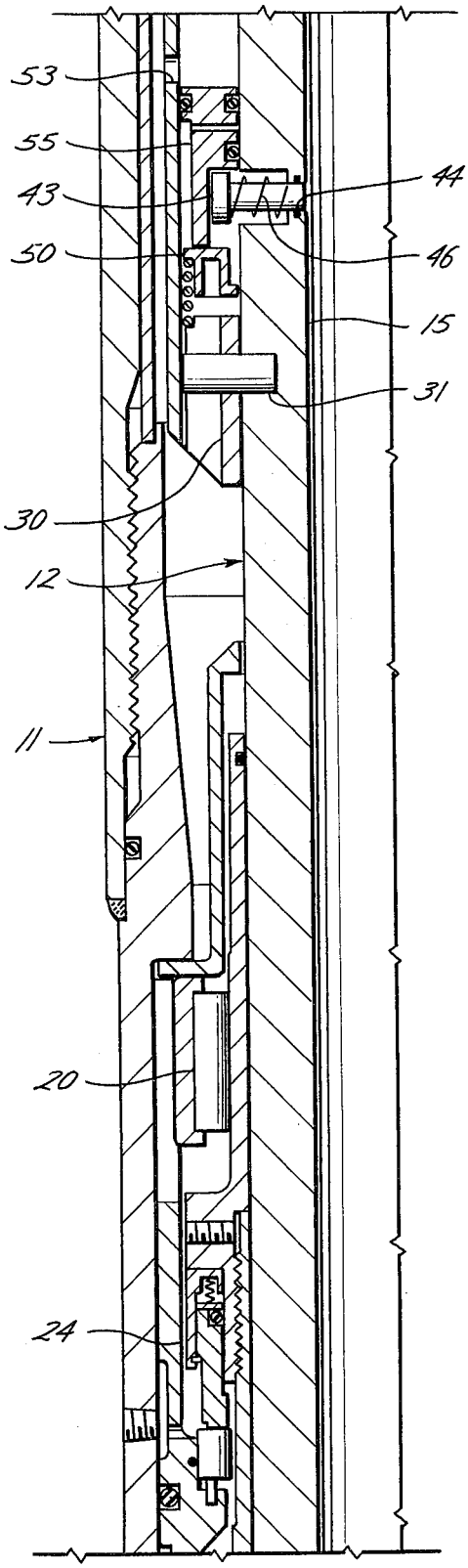

WELL DRILLING TOOL

This invention relates generally to well drilling tools having tubular members which are supported for relative rotation by means of bearings contained within a lubricant chamber in an annular space between the members. More particularly, it relates to improvements in tools of this type having a reservoir for supplying additional lubricant to the lubricant chamber in the event of loss of same during use of the tool.

In use, the tool is connected as part of a drilling string, and drilling fluid is circulated downwardly through a passageway formed by the tubular members and upwardly within the annulus between the tool and well bore. Thus, one such member may comprise a housing or case suspended from the lower end of the string, the other may comprise a hollow shaft rotatably supported by the case and having a bit on its lower end, and a motor, such as a turbine, may be disposed within the annular space between the case and a shaft for rotating the shaft and thus the bit without the necessity of transmitting torque from the surface to the case through thousands of feet of drilling string. The passageway thus includes the annular space which is connected by ports through the shaft to the bore of the shaft leading to the bit at its lower end.

The seals which define the lubricant chamber are highly susceptible to failure due to abrasive materials in the drilling fluid, especially since they are disposed between shaft and case or other relatively rotating tubular members of the tool. As lubricant leaks from the chamber, and is replaced by the heavier drilling fluid, the bearings are quickly worn and the tool must be retrieved to permit their replacement and/or repair.

In an effort to lengthen the usable life of the bearings, it was proposed in my prior U.S. Pat. No. 3,971,450 to provide, in a tool of this type, a reservoir for supplying lubricant to the chamber as the need arose during the use of the tool. More particularly, and as shown in such patent, a piston slidable within the reservoir has one side responsive to pressure of the drilling fluid to force lubricant from the reservoir and into the lubricant chamber automatically in response of loss of the lubricant. However, the operator of this tool is unable to determine if and when lubricant is lost, much less to what extent, and thus has no way to anticipate impending damage to the bearings, so that the bearings may be damaged before the operator is able to pull the tool from the well bore.

It is therefore the primary object of the present invention to provide a well drilling tool of this latter type in which damag to the bearings may be anticipated, and, more particularly, in which the loss of a predetermined volume of lubricant may be detected at the surface of the well.

Another object is to provide a tool of this type in which detection of the loss does not require a direct correction, electrical or otherwise, between the tool and the surface of the well.

These and other objects are accomplished, in accordance with the illustrated embodiment of the present invention, by a tool of this type which has means for indicating to an operator at the surface that the volume of lubricant within the reservoir has decreased a predetermined amount, and thus permitting him to pull the tool before the drilling fluid has access to the lubricated bearing chamber. More particularly, this means responds to the decrease in the volume of lubricant within the reservoir to restrict the flow of drilling fluid through the passageway, so that the operator is able to observe the resulting increase in pressure in the drilling fluid at the surface.

Flow through the passageway of the tool is so restricted by a part which, in response to a predetermined decrease in the volume of lubricant within the reservoir, is released from a supported position within the passageway, in which it does not significantly restrict flow therethrough, to permit it to move to another position in which it is received by a means within the bore which, with said part, significantly restricts the flow path through the passageway. Preferably, the releasable part comprises a sleeve which fits closely within the passageway, and the means for receiving such part comprises a spider which bridges the passageway and has an annular opening into which the sleeve fits, once so released to restrict the flow of drilling fluid to only a restricted central opening in the spider.

More particularly, a second part is movable longitudinally within the reservoir, in response to a decrease in the volume of lubricant therein, and the sleeve is released when the second part has moved to a predetermined longitudinal position within the reservoir. In the preferred and illustrated embodiment of the invention, the body has an opening connecting the bore and the reservoir, and a retainer is sealably reciprocal within the opening between an inner position in which it supports the sleeve and an outer position in which it releases the sleeve. A means is provided within the reservoir for releasably holding the retainer in its inner position, and the second part is engageable with this holding means to cause it to release the retainer when the second part is moved into its predetermined longitudinal position. Preferably, a spring means acts between the retainer and the body of the tool to urge the retainer to its outer position, whereby it automatically releases the sleeve when the holding means is moved to releasing position.

In the illustrated embodiment of the invention, the second part comprises a piston which separates the lubricant from drilling fluid and is responsive to the pressure of the drilling fluid so as to force the lubricant into the chamber as it moves in one longitudinal direction. Thus, the piston engages with the holding means to cause it to release the retainer, when the piston has moved into its predetermined longitudinal position. Preferably, and as illustrated, the piston, the portion of the chamber in which it is slidable, as well as the holding means, are of annular shape.

In the drawings, wherein like reference characters are used throughout to designate like parts:

FIG. 2 is enlarged vertical sectional view of one side of a portion of the tool of FIG. 1, including the reservoir, piston and sleeve, such portion also being discontinued intermediate its length for purposes of clarity;

FIG. 3A is another vertical sectional view of one side of a portion of the tool, including the reservoir, piston and sleeve, but differing from FIG. 2 in that the piston slidable within the reservoir has moved to a position for releasing the retainer for the sleeve;

Figure 1:
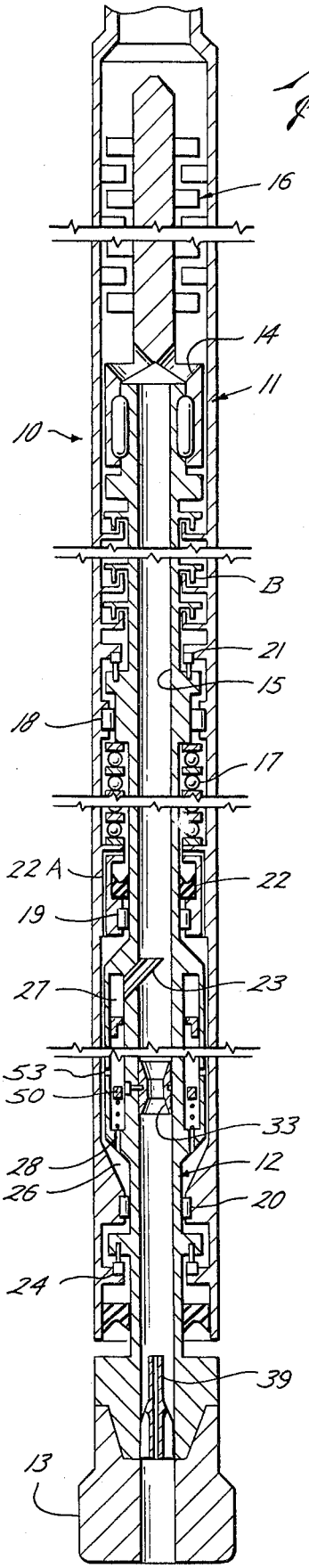
FIG. 1 is a vertical sectional view of a tool constructed in accordance with the present invention, such tool being discontinued at different levels along its length for purposes of clarity.

With reference now to the details of the above-described drawings, the overall tool, which is indicated in its entirety by reference character 10, is shown in FIG. 1 to comprise a housing or case 11 having its upper end adapted to be connected to the lower end of the drill string (not shown), and a shaft 12 mounted for rotation within the case 11 and supporting a bit 13 at its lower end. Thus, the case and shaft constitute relatively rotatable tubular members which make up a body extending from connection of the upper end of the case with the drill string to connection of the lower end of the shaft with the bit.

As well known in the art, the tool is lowered on the drill string into a well bore, and drilling fluid of relatively heavy specific gravity is circulated downwardly through the drill string and the tool, out the lower end of bit 13, and upwardly within the annulus between the tool and the well bore. As shown in FIG. 1, ports 14 connect an annular space between the upper end of the shaft and the case with a bore 15 through the shaft connecting at its lower end with a bore through bit 13. Thus, the case and shaft form a passageway through the body of the tool 10 connecting the well string with the bore.

In the illustrated tool, shaft 12 is rotated with respect to case 11, so as to impart rotation to bit 13, by means of a turbine 16 comprising stators on the inner diameter of the case, and cooperating rotors on the outer diameter on the upper end of shaft 12 above ports 14 in the shaft. Hence, the tool comprises what is known as a turbodrill wherein the shaft and thus the bit 13 are caused to rotate in response to the circulation of drilling fluid downwardly through the turbine 16.

The portion of the shaft 12 below ports 14 is spaced from the case 11 to provide an annular space in which bearings are received for supporting the shaft from the case. As shown in FIG. 1, these bearings include thrust bearings 17 in the form of balls mounted as an assembly between a downwardly facing shoulder on the shaft and an upwardly facing shoulder on the case, as well as radial bearings 18, 19 and 20 in the form of rollers carried by the case for rotation about vertical axes. As shown in FIG. 1, the bearings are contained within a lubricant chamber 26 within the space formed between upper and lower seals 21 and 24 sealing between the case and shaft, the thrust bearings 17 and upper radial bearings being separated from the remainder of the lubricant chamber beneath them by a seal 22.

Both seals 21 and 24 are so-called "face" types of well known construction, but reversed end for end with respect to one another so that upper seal 21 is arranged to prevent flow therepast in an upward direction and lower seal 24 is arranged to prevent flow therepast in a downward direction. The lower seal 22 comprises one or more cup-type sealing rings of resilient material having upwardly diverging lips on their inner and outer diameters, which permit flow therepast in an upward direction, but prevent it in a downward direction. One or more ports 22A are formed in the case to connect with the lubricant chamber 26 above and below seal 22, and a check valve (not shown) in each such port prevents flow therethrough in an upward direction, but permitting flow therethrough in a downward direction, to bypass seal 22, when the pressure in the portion of the chamber above seal 22 exceeds that below it by a predetermined amount.

An annular space is formed within the shaft to provide a reservoir 27 from which lubricant may be supplied to the lubricant chamber. The lower end of the reservoir is connected to the lubricant chamber by one or more ports 28, and a tube 23 connects the bore through the shaft with the upper end of the reservoir. Thus, drilling fluid above seal 21 and below seal 22 is ordinarily at substantially the same pressure, and the differential pressure between drilling fluid on the inside and outside of the tool is taken across the lower seal 24, so that a leak from the lubricant chamber will ordinarily first occur at its lower end—i.e., at seal 24.

However, the lubricant is normally of a specific gravity considerably less than that of the relatively heavy drilling fluid. Consequently, there may be considerable pressureonstruction, such as that shown and described in my prior U.S. Pat. No. 3,971,540. Thus, as illustrated in FIG. 3A, each includes sleeves mounted on each of the shaft and case, and having annular flat, annular surfaces on their ends which are caused to slide over one another during rotation of the shaft with respect to the case.

As shown in FIGS. 2 and 3A, the shaft 12 includes a sleeve 32 mounted about an inner portion thereof to form the inner and outer walls of the annular space in which reservoir 27 is formed. The upper end of the space is closed by means of a ring 29 welded or otherwise secured to the sleeve 32 and having seal rings about its inner and outer diameters for sealing with respect to the shaft and sleeve, respectively. The lower end of sleeve 32 is disposed about another ring 30 which is mounted on the shaft by means of a pin 31. Port 28 is formed through ring 30 to connect the lower end of reservoir 27 with the lubricant chamber.

An annular piston P having seal rings on its inner and outer diameters is sealably slidable within reservoir 27 to separate the upper level of lubricant therein from drilling fluid admitted to the reservoir from bore 15 of the shaft through tube 23. The drilling fluid constantly urges the piston in a downward direction so that if lubricant leaks past seal 24 and out of the lubricant chamber, additional lubricant is supplied thereto from the reservoir. Inasmuch as tube 23 extends upwardly as well as inwardly, it has a pitot tube effect to insure that drilling fluid is applied to the piston at a pressure higher than that which acts over the upper end of seal 21.

As lubricant is supplied from the reservoir to the lubricant chamber, Piston P gradually moves downwardly. Although FIGS. 1 and 2 are discontinuous intermediate the length of the reservoir, it will be understood that it may be of considerable length. However, when piston P approaches the lower end of the reservoir, a means is provided for indicating to the operator at the wellhead that this level has been reached, and thus that continued use of the tool runs the risk of damaging the bearings, so that the operator may discontinue circulation and pull the tool from the well bore.

Figure 3B:
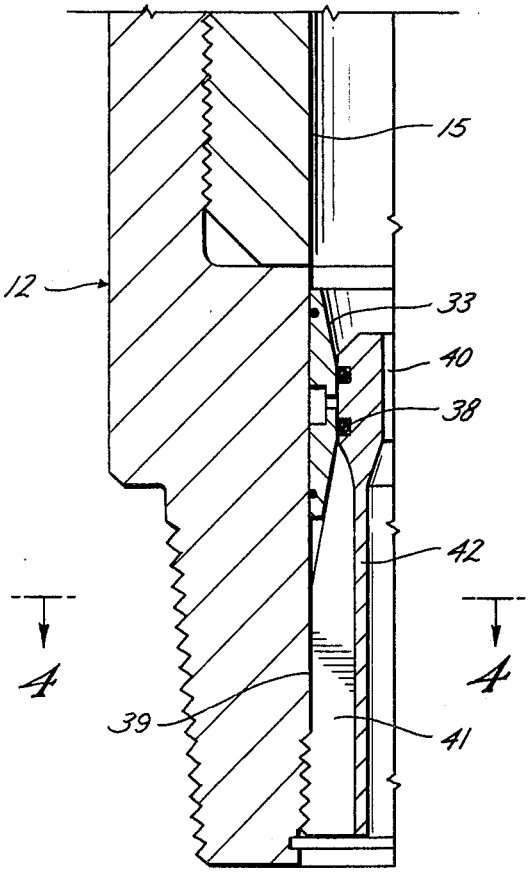
FIG. 3B is a vertical sectional view of a lower portion of the tool showing the sleeve upon release and reception within an annular opening in the spider of the tool mounted in a lower end of the passageway therethrough.

As previously mentioned, this indicating means comprises a sleeve 33 received within the bore 15 of the shaft with its outer diameter fitting closely within the bore and sealed with respect thereto by means of seal rings 34. The sleeve 33 is held in an upper position (FIG. 2) within the bore by means of one or more retainer pins 35 extending through holes in the shaft connecting its bore with the reservoir portion 27. The pin is shiftable between an inner position in which its inner end fits within an annular groove 37 about the sleev to hold the sleeve in the position of FIG. 2, and an outer position in which the pin is withdrawn from the groove, as shown in FIG. 3A, to permit the sleeve to move downwardly to a position within the lower end of the bore, as shown in FIG. 3B.

Figure 4:
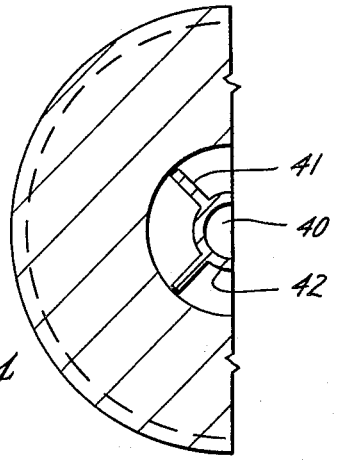
FIG. 4 is a cross-sectional view of the tool, as seen along broken lines 4—4 of FIG. 3B.

Inasmuch as the sleeve is relatively thin, it provides a minimum of obstruction to flow through the bore 15 of the shaft when supported in the upper position of FIG. 2. When it is released, sleeve 33 falls downwardly into an annular opening 38 of a bridge 39 threadedly connected within a lower portion of the bore. When the sleeve is so received, it diverts all flow through a central opening 40 in the spider which is of considerably lesser cross-sectional area than that through the sleeve so as to cause a noticeable increase in the pressure of the drilling fluid which may be observed by the operator at the wellhead. As best shown in FIGS. 3B and 4, the spider includes legs 41 which extend radially from a central hub 42 through which the central opening 40 is formed. The legs support the sleeve when received in the annular space 38 of the bridge. The lower ends of legs 41 are threadedly connected to the bore 15 to support the bridge in the position shown in FIG. 3B, and the spaces between the legs form continuations of the flow path through annular opening 38 prior to reception of sleeve 33.

As shown in FIGS. 2 and 3A each retainer pin 35 has a head 43 on its outer end which fits within the enlarged outer portion of opening 36, and the stem of the pin extends through the reduced inner end portion of opening 36. A seal ring 44 is mounted within the opening to form a sliding seal about the stem as the retainer pin moves between its inner and outer positions of FIGS. 2 and 3A. A hole 45 is formed in the sleeve to connect with its annular recess 37 and thus prevent a pressure lock which might otherwise interfere with the free movement of the sleeve downwardly within the bore 15 when released. Each of the retainer pins 35 is urged to its outer position, in which the inner end of its stem is withdrawn from the bore 15 of the shaft, by means of a coil-spring 46 surrounding the stem and acting between the head 43 on the stem and a shoulder connecting the enlarged and reduced diameter portions of the opening 36.

Each of the retainer pins may be held in its inner position by means of a ring 50 disposed within reservoir 27 and having an inner circumference 51 adapted to engage the outer ends of heads 43 to oppose the forces of springs 46.

Thus, in order for the retainer pins to be moved to their outer positions under the influence of spring 46, holding ring 50 must be moved downwardly in the reservoir to a position in which the inner diameter 51 thereof is removed from engagement with the outer ends of retainer pin heads 43. As shown, ring 50 is held in holding position by means of a coil-spring 52 compressed between the upper end of ring 30 and an annular flange about the outer diameter of ring 50. More partiularly, the force of this coil-spring holds an annular flange about the inner diameter of the holding ring upwardly against the lower edges of the heads 43 of the retainer pins so as to limit upward movement of the holding ring 50 beyond the position of FIG. 2.

The holding ring is adapted to be moved downwardly out of holding position by a lower extension 55 of piston P as the piston moves downwardly to the position of FIG. 3A upon the loss of a predetermined volume of lubricant from the reservoir. Thus, as shown, the inner diameter of the extension moves downwardly past the heads of the retainer pins and is of such length as to insure movement of the inner diameter 51 of the holding ring to a position past the heads before the inner portion of the piston lands upon such heads, as shown in FIG. 3A. Preferably, downward movement of the piston is limited by compression of spring 52 before the piston lands on the heads of the retainer pins.

As shown in FIGS. 2 and 3A, a port 53 formed in sleeve 32 is uncovered by piston P as the piston moves to the position of FIG. 3A to release sleeve 33. Thus, until the circulation of the drilling fluid is discontinued, high pressure drilling fluid bypasses the reservoir to flow into the lubricant chamber 26, from which it will ordinarily flow out of the tool past lower seal 24, which, as previously noted, is the most susceptible to wear. This then prevents the pressure differential between the drilling fluid inside and outside of the tool from acting over upper seal 21, so that, with seal 22 disposed beneath thrust bearings 17 they, together with upper bearing 18, are in any event protected from the drilling fluid. That is, only bearings 19 and 20 may be damaged by any drilling fluid which enters the annular chamber 26. e understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described what is claimed is:

1. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, means within the body providing a reservoir for supplying additional lubricant to the chamber, and means for indicating to an operator at surface level that the volume of lubricant within the reservoir has decreased a predetermined amount.

2. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, means within the body providing a reservoir for supplying additional lubricant to the chamber, and means responsive to a predetermined decrease in the volume of lubricant within the reservoir for restricting the flow of drilling fluid through the passageway.

3. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, means within the body providing a reservoir from which additional lubricant may be supplied to the chamber, a part releasably supported in the passageway of the body, means for releasing said part in response to a predetermined decrease in the volume of lubricant within the reservoir, and means within the passageway for receiving said part, when so released, in order to restrict the flow of drilling fluid through the passageway.

4. A tool of the character defined in claim 3, wherein the releasable part comprises a sleeve fittable closely within the passageway, and the means for receiving said part has an annular opening into which the sleeve fits when so released.

5. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, means within the body providing a reservoir for supplying additional lubricant to the chamber, a first part movable longitudinally within the passageway means releasably supporting the first part within the bore, a second part movable longitudinally within the reservoir in response to a decrease in the volume of the lubricant, means for releasing the first part when the second part has moved to a predetermined longitudinal position within the reservoir, and means within the passageway for receiving said first part, when so released, in order to restrict the flow of drilling fluid through the passageway.

6. A tool of the character defined in claim 5, wherein the first part is a sleeve fittable closely within the passageway, and the means for receiving the first part has an annular opening into which the sleeve fits when so released.

7. A tool of the character defined in claim 5, wherein said body has an opening therein connecting the passageway and reservoir, a retainer is sealably reciprocable within the opening between an inner position in which it supports the first part and an outer position in which it releases said first part, means are provided within the reservoir for releasably holding said retainer in its inner position, and said second part is engageable with the holding means to cause it to release said retainer, when said second part has moved into said predetermined longitudinal position.

8. A tool of the character defined in claim 7, including spring means acting between the retainer and body to urge said retainer to its outer position.

9. A well drilling tool, comprising an elongate body connectible as part of a drill string, said body having relatively rotatable tubular members forming a passageway through which drilling fluid may be circulated and an annular space between the members, bearings within the annular space supporting one member from the other, means sealing between said members with the space to form a lubricant chamber for the bearings, means within the body providing a reservoir for supplying additional lubricant to the chamber, a first part movable longitudinally within the passageway, means releasably supporting the first part within the passageway, a piston sealably slidable longitudinally the reservoir, one side of the piston being responsive to the pressure of the drilling fluid so as to force lubricant into said chamber as the piston is moved in one longitudinal direction, means for releasing said part in the passageway when the piston has moved to a predetermined longitudinal position within the reservoir, and means within the passageway for receiving said part, when so released, in order to restrict the flow of drilling fluid through the passageway.

10. A tool of the character defined in claim 9, wherein the part in the passageway is a sleeve fittable closely within the bore, and the means for receiving the part has an annular opening into which the sleeve fits when so released.

11. A tool of the character defined in claim 9, within said body has an opening therein connecting the passageway and reservoir, a retainer is sealably reciprocable within the opening between an inner position in which it supports the part in the passageway and an outer position in which it releases said part, means are provided within the reservoir for releasably holding said retainer in its inner position, and said piston is engageable with the holding means to cause it to release said retainer, when said piston has moved into said predetermined longitudinal position.

12. A tool of the character defined in claim 11, wherein the piston, the reservoir, and the holding means are annular.

13. A tool of the character defined in claim 11, including spring means acting between the retainer and body to urge said retainer to its outer position.

14. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, and means for indicating to an operator at surface level that the volume of said lubricant has decreased a predetermined amount.

15. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, and means responsive to a predetermined decrease in the volume of said lubricant for restricting the flow of drilling fluid through the passageway.

16. A well drilling tool, comprising an elongated body connectible as part of a drill string, said body having relatively rotatable tubular members forming a passageway through which drilling fluid may be circulated and an annular space between the members, bearings within the annular space supporting one member from the other, means sealing between the members within the space to form a lubricant chamber for the bearings, a part movable within the body from a first position to a second position in which it restricts flow through the passageway to a greater extent than it does in its first position, means for retaining said part in its first position, and means for releasing said retaining means so as to permit said part to move to said second position when the volume of said lubricant has decreased a predetermined amount.

17. A tool of the character defined in claim 16, wherein said releasing means comprises a piston movable within the body in response to decreases in the volume of said lubricant.

* * * * *